US008230658B2

(12) United States Patent
Molteni

(10) Patent No.: US 8,230,658 B2
(45) Date of Patent: Jul. 31, 2012

(54) POST ASSEMBLY FOR PARTITIONING WALLS

(75) Inventor: Piero Molteni, Milan (IT)

(73) Assignee: Unifor S.p.A., Turate (Como) (IT)

( * ) Notice: Subject to any disclaimer, the term of this patent is extended or adjusted under 35 U.S.C. 154(b) by 164 days.

(21) Appl. No.: 12/302,714

(22) PCT Filed: May 23, 2007

(86) PCT No.: PCT/IT2007/000364

§ 371 (c)(1),
(2), (4) Date: Jan. 7, 2009

(87) PCT Pub. No.: WO2007/138631

PCT Pub. Date: Dec. 6, 2007

(65) Prior Publication Data

US 2009/0223138 A1 Sep. 10, 2009

(30) Foreign Application Priority Data

May 30, 2006 (IT) ..... MI2006U0197

(51) Int. Cl.

| | |
|---|---|
| ***E04C 2/34*** | (2006.01) |
| ***E06B 3/988*** | (2006.01) |
| ***E04H 1/00*** | (2006.01) |
| ***E04H 17/16*** | (2006.01) |
| ***E04B 1/38*** | (2006.01) |
| ***E04B 1/00*** | (2006.01) |
| ***E04B 9/00*** | (2006.01) |
| ***E04B 2/00*** | (2006.01) |

(52) U.S. Cl. ..... 52/481.1; 52/481.2; 52/204.71; 52/238.1; 52/52; 52/282.1; 52/281; 52/479; 52/582.1; 256/24

(58) Field of Classification Search ..... 52/204.71, 52/238.1, 282.1, 281, 479, 481.1, 582.1; 256/24

See application file for complete search history.

(56) References Cited

U.S. PATENT DOCUMENTS

| | | | | |
|---|---|---|---|---|
| 3,378,977 | A * | 4/1968 | Vervloet | 52/481.2 |
| 3,512,819 | A * | 5/1970 | Gillingwater et al. | 52/461 |
| 3,640,039 | A * | 2/1972 | McKee et al. | 52/281 |
| 4,016,690 | A * | 4/1977 | Richardson | 52/238.1 |
| 4,269,005 | A | 5/1981 | Timmons | |
| 4,625,483 | A * | 12/1986 | Zacky et al. | 52/239 |
| 4,953,338 | A | 9/1990 | Wilson et al. | |
| 5,007,222 | A * | 4/1991 | Raymond | 52/586.1 |
| 5,054,255 | A | 10/1991 | Maninfior | |
| 5,272,850 | A * | 12/1993 | Mysliwiec et al. | 52/582.2 |
| 6,421,968 | B2 * | 7/2002 | Degelsegger | 52/204.62 |
| 6,799,404 | B2 * | 10/2004 | Spransy | 52/582.1 |

FOREIGN PATENT DOCUMENTS

| | | |
|---|---|---|
| GB | 2128707 A | 2/1984 |
| GB | 2128707 A | 5/1984 |

* cited by examiner

*Primary Examiner* — Brian Glessner
*Assistant Examiner* — Omar Hijaz
(74) *Attorney, Agent, or Firm* — Shoemaker and Mattare

(57) ABSTRACT

The post assembly comprises a pair of juxtaposed and spaced apart post sections, the facing sides of which are provided internally with a longitudinal groove, the longitudinal grooves ] being arranged in alignment with one another and forming in co-operation, in their respective positions, a recess for receiving a longitudinal support rack member for supporting overhanging removable elements.

3 Claims, 2 Drawing Sheets

POST ASSEMBLY FOR PARTITIONING WALLS

TECHNICAL FIELD

The present invention relates to a post assembly for partitioning walls, particularly of the kind having a support member for supporting removable overhanging elements, which is adapted to permit said elements to be easily secured into position, without requiring the use of screws, bolts or other connecting means.

BACKGROUND ART

There are known in the art post assemblies used in the erection of partitioning walls inside living spaces or intended spaces for offices, stores or wholesale shops. In some embodiments known in the art, the post assemblies are made of a tubular or semi-tubular section which has, in cross-section, a shape that is appropriate to a desired aesthetic appearance and exhibits lengthwise a groove which is adapted to receive a longitudinal support rack member onto which removable overhanging elements can be secured to form supports for shelves, suspended fixtures or the like.

A drawback of these known embodiments is that the longitudinal support rack member is exposed to view along almost its entire length, thereby producing a disagreeable contrast with the wall partitioning elements which are fixed to the post assemblies. Such an aesthetic discordance is particularly apparent in the case the wall partitioning elements are made of decorative panels or they consist of panes of transparent or translucent material.

The present invention is aimed at obviating the aforementioned drawback by providing an improved post assembly for partitioning walls, having a support member for overhanging removable elements, which member remains practically hidden to sight, thus giving a higher aesthetic quality to the partitioning wall.

DISCLOSURE OF INVENTION

This object is achieved by the invention in that the post assembly comprises a pair of juxtaposed and spaced apart post sections, the facing sides of which are each provided internally with a longitudinal groove, the longitudinal grooves of said facing sides of the post sections being arranged in alignment with one another and forming in co-operation, in their respective positions, a recess for receiving a longitudinal support rack member for supporting overhanging removable elements.

BRIEF DESCRIPTION OF DRAWINGS

The present invention will now be described in more detail with reference to the attached drawings, wherein.

BEST MODE OF CARRYING OUT THE INVENTION

Figure 1:
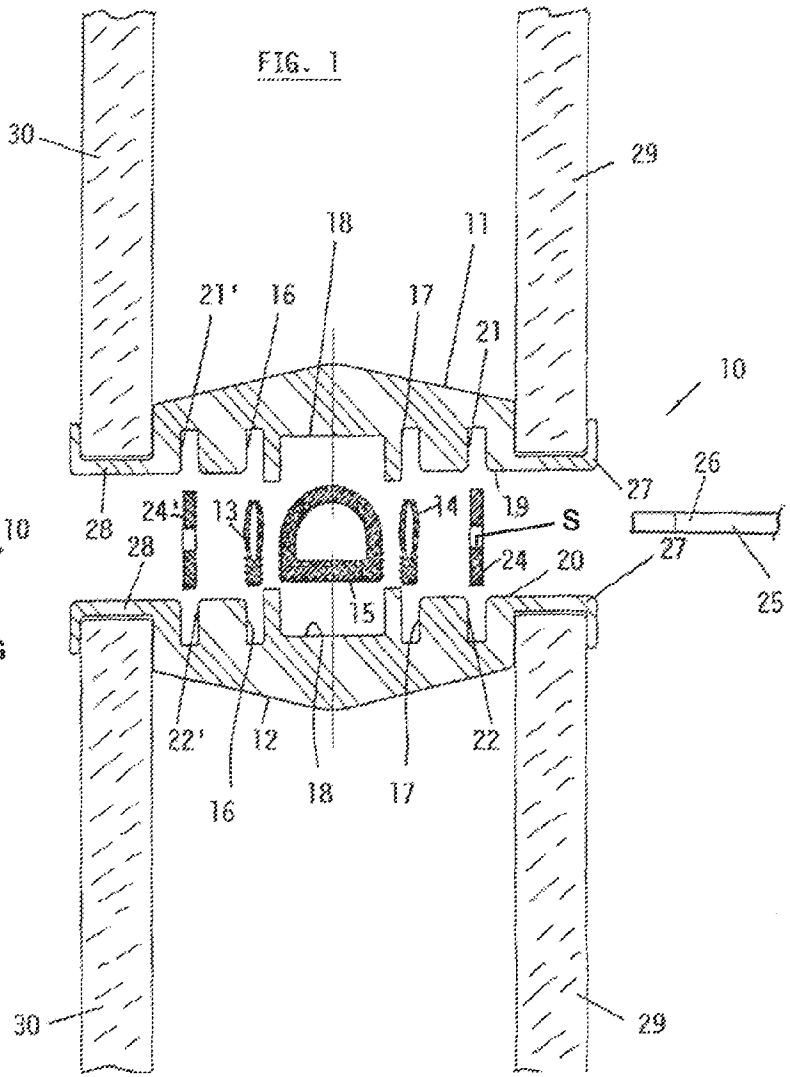
FIG. 1 is a cross-section view of the post assembly in a disassembled state.
Figure 2:
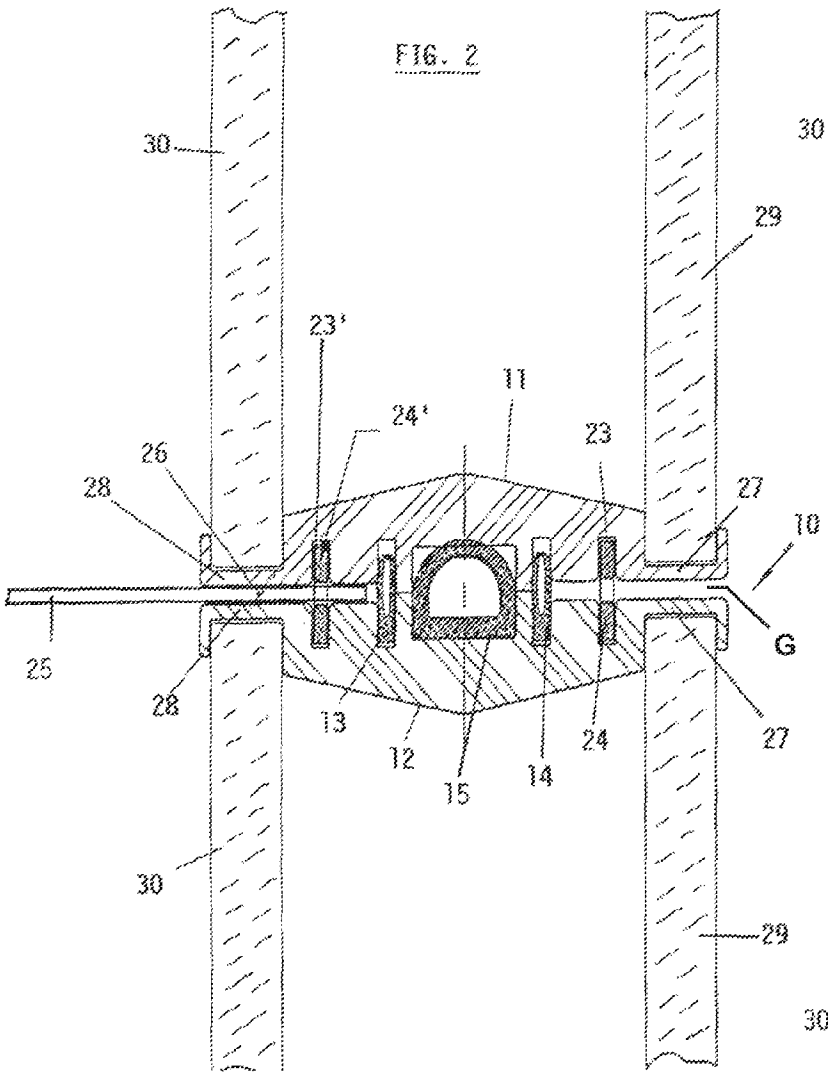
FIG. 2 is a cross-section view of the post assembly in an assembled state.

The post assembly according to the invention, generally designated by 10 in FIGS. 1 and 2 of the drawings, comprises essentially a pair of juxtaposed post sections 11, 12, which are connected one another by means of longitudinal connecting elements 13, 14, 15 arranged in suitable longitudinal channels 16, 17, 18 of the post sections. Post sections 11, 12 are made of metal material, e.g. aluminum. Elements 13, 14, 15 are made of rubber or the like. Connecting element 15 is configured as a tubular element having, in cross section, a "D" shaped configuration and thus is adapted to keep the facing sides 19, 20 of the post sections 11, 12 apart.

Facing sides 19, 20 of the post sections 11, 12 are each provided internally with a longitudinal groove 21, 22. These longitudinal grooves 21, 22 are aligned with one another and form in co-operation, in their respective positions, a recess 23 for receiving a longitudinal support member 24 onto which overhanging removable elements 25 can be secured to form supports for shelves, suspended fixtures or the like.

The sides opposite the facing sides 19, 20 of the post sections 11, 12 exhibit, instead, a continuous profile, i.e. without longitudinal grooves or recesses, in cross-section, and have a convex angular shape.

Preferably, the longitudinal support member 24 consists of a rack member made of metal material, e.g. steel, in order to assure an excellent strength.

The securing of the overhanging elements 25 is obtained in an easy manner, without requiring the use of screws, bolts or other connecting means. To this purpose, a special elongated and slender portion 26 of the overhanging element 25 is inserted into the gap "G" between the facing sides 19, 20 of the post sections 11,12 to engage with the slots "S" of the rack member.

Conveniently, provision can be made for two pairs of grooves 21, 22 and 21', 22', each pair being adapted to form a recess 23, 23' for receiving a longitudinal support member 24, 24'. By this arrangement, overhanging removable elements can be secured onto each side of a partitioning wall supported by the post assembly 10.

The post assembly 10 permits decorative panels or panes of transparent or translucent material to be assembled on opposite sides. To this purpose, each post section 11, 12 forming the post assembly 10 comprises wings 27, 28 which are folded at an angle to form a "U" shaped recess into which the edges of the panels or panes 29, 30 of the partitioning wall can be inserted.

Figure 3:
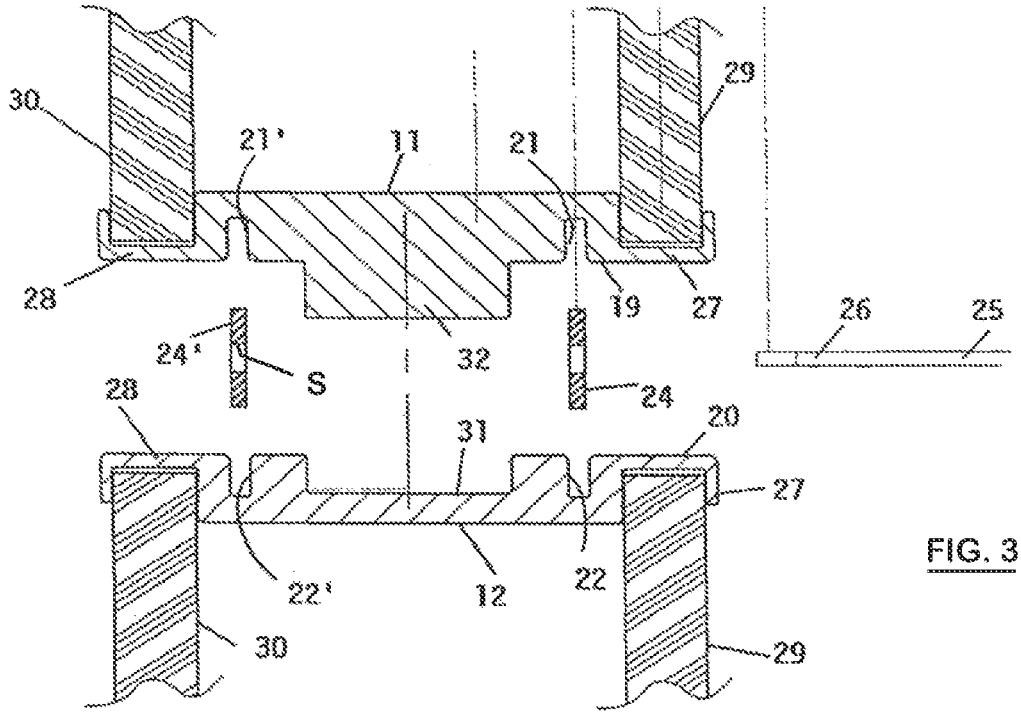
FIG. 3 is a cross-section view of a variant of the post assembly of the invention in a disassembled state.
Figure 4:
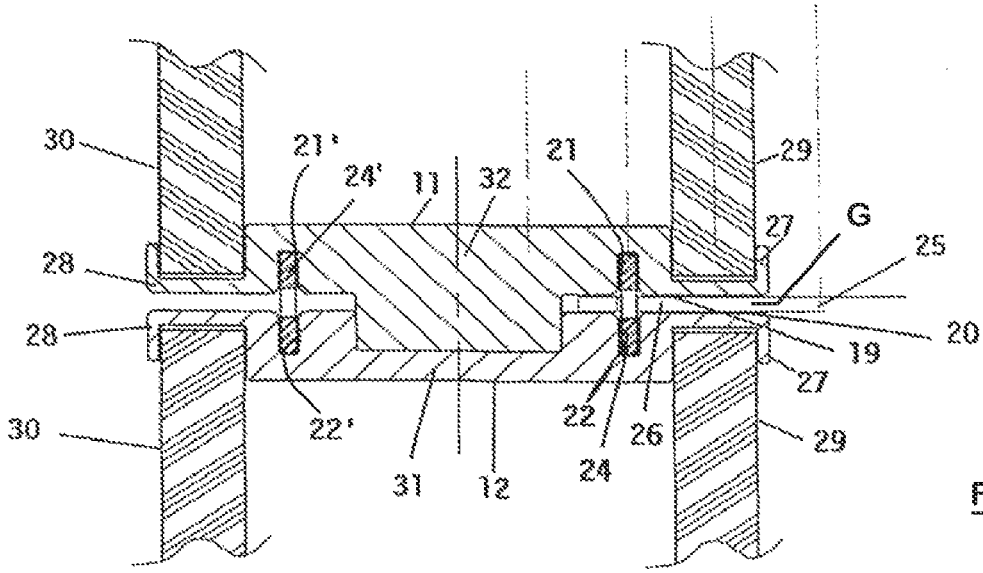
FIG. 4 is a cross-section view of the variant of the post assembly of the invention in an assembled state.

Referring to FIGS. 3 and 4 of the drawings, there is shown a variant of the post assembly according to the invention.

The post assembly of this variant, generally designated by 10, comprises a pair of juxtaposed post sections 11, 12. The facing sides 19 and 20 of the post sections 11, 12 are provided with a groove 31, and a mating ledge 32, respectively. The groove 31 and the ledge 32 extend lengthwise the post sections for a substantial length thereof. The height of the ledge 32 is greater than the depth of the groove 31, thus in the assembled configuration of the post assembly, when the post sections 11, 12 mate and the ledge on post section 12 is received into the groove 31 on post section 11, a gap "G" exists between the facing sides 19, 20 of the post sections 11, 12.

Also in the variant shown in FIG. 3 and 4 of the drawings, the facing sides 19, 20 are each provided internally with at least a longitudinal groove 21, 22. These longitudinal grooves 21, 22 are aligned with one another and form in co-operation, in their respective positions, a recess 23 for receiving a longitudinal support member 24 onto which overhanging removable elements 25 can be secured to form supports for shelves, suspended fixtures or the like. The securing of the overhanging elements is obtained, also in this variant, by inserting a special elongated and slender portion 26 of the overhanging element 25 into the space gap between the facing sides 19, 20 of the post section 11, 12 to engage with the slots of the rack member.

Also in this variant, provision can be made for two pairs of grooves 21, 22 and 21', 22', each pair being adapted to form a recess 23, 23' for a longitudinal support member 24, 24'. With this arrangement, the overhanging removable elements can be secured onto each side of a partitioning wall supported by the post assembly 10.

The post assembly according to the present invention achieves the aimed object of hiding from view the longitudinal support rack member 24, 24' for its entire length. The recess 23, 23' for receiving the longitudinal support rack member 24, 24' is located adequately inside the post assembly 10, behind the recess formed by wings 27, 28, thus being practically covered thereby and therefore invisible.

Because the rack member 24, 24' is hidden from view, it does not require the application of a special finish and this greatly reduces the cost thereof.

Furthermore, because the rack member 24, 24' is separate from the sections forming the post assembly 10 it can be adjusted in height independently from the post sections by suitable adjusting means of the kind known in the art. This feature is useful, in particular, when the partitioning wall is erected on a non perfectly leveled floor, because it permits the overhanging elements 25 to be mounted in any case at a same level.

What is claimed is:

1. A post assembly for erecting partitioning walls and receiving product hangers, said assembly comprising a pair of juxtaposed post sections, said juxtaposed post sections having facing sides with a gap therebetween, said facing sides each having a pair of parallel longitudinal grooves, said longitudinal grooves of the facing sides of the post sections being aligned with one another, each opposed pair of longitudinal grooves forming a respective recess, and a pair of longitudinal support rack members, one of said longitudinal support rack members being contained in each said recess, each said longitudinal support rack member having slots therein for receiving removable hanger elements which may be inserted through the gap between said post sections into said slots, each of the post sections having wings defining respective "U" shaped recesses into which recesses edges of panels or panes can be inserted to form a partitioning wall, the grooves for receiving the longitudinal support rack member being located behind the recesses defined in the wings, wherein each of the post sections has at least one longitudinal channel on the facing sides thereof, between said longitudinal grooves, and a connecting element inserted into and bridging said channels, to interconnect said post sections and each said connecting element is configured as a tubular element having a cross section sufficiently large to keep the facing sides of the post sections spaced apart.

2. The post assembly according to claim 1, wherein each of said post sections has an outer surface, opposite the facing sides of the post sections, said surface having a continuous profile in cross-section and a convex angular shape.

3. A partition wall assembly comprising (a) at least one post assembly as recited in claim 1, (b) a plurality of wall panels, each seated in one of the U-shaped recess of an adjacent post assembly, and (c) a plurality of hangers, each of the hangers having a portion inserted through said gap between the post sections and engaging at least one of the slots in the support rack member within said post assembly.

* * * * *